United States Patent [19]

Greene

[11] Patent Number: 4,903,010

[45] Date of Patent: Feb. 20, 1990

[54] INTRUSION DETECTION SWITCH HOUSING

[76] Inventor: Teddy R. Greene, 2171 Research Dr., Livermore, Calif. 94550

[21] Appl. No.: 277,162

[22] Filed: Nov. 29, 1988

[51] Int. Cl.[4] ..... G08B 23/00; G08B 13/08

[52] U.S. Cl. ..... 340/693; 340/541; 340/545; 200/61.7; 335/205

[58] Field of Search ..... 340/693, 545, 546, 547, 340/549, 551; 335/205, 207; 200/61.7, 51/61.72, 61.73, 61.74, 61.75, 61.62, 61.8, 61.81

[56] References Cited

U.S. PATENT DOCUMENTS 3,896,404 7/1975 Peterson ..... 335/205
4,148,001 4/1979 Gwozdz ..... 200/61.7
4,700,163 10/1987 Wolfe, Jr. ..... 200/61.7

OTHER PUBLICATIONS

United Security Products, Inc., Magnetic Switch Product Literature, Nov. 29, 1988.

*Primary Examiner*—Donnie L. Crosland
*Assistant Examiner*—Kinfe-Michael Negash
*Attorney, Agent, or Firm*—Townsend and Townsend

[57] ABSTRACT

A threadably installable intrusion detection unit. The unit has a generally cylindrical housing with an exterior threaded surface and an end portion formed to receive a screw driver. An operative intrusion detection element, such as a magnetic or a reed switch, is contained within the hollow interior of the housing.

7 Claims, 1 Drawing Sheet

INTRUSION DETECTION SWITCH HOUSING

BACKGROUND OF THE INVENTION

The present invention relates to intrusion detectors for door or window assemblies or the like, and is more particularly directed to an easily installable magnetic switch assembly.

Intrusion detectors for home security are used to sound an alarm or provide other warning signals when a window or door or the like is opened. One common type of intrusion detector is a magnetic switch assembly having two separate constituent pieces. One piece provides a magnetically sensitive switch, such as a reed switch, and the other piece provides a magnet. The magnet is mounted in an edge of the door or window to be protected, and the reed switch is mounted opposite the magnet in the adjacent frame or casing of the door or window. The reed switch is electrically connected by wires or appropriate cabling routed through the walls to control circuitry for the alarm system. When the intrusion detection system is activated and the window or door is opened, movement of the magnet away from the reed switch trips the switch and energizes the alarm.

In known intrusion detectors of this type the reed switch and the magnet are each typically encapsulated in a generally cylindrical, and sometimes tapered, plastic casing. Each piece is installed by inserting it into a hole pre-drilled in the door or frame, setting the right depth, then sealing it in position, and spackling and painting over it so as to be unnoticeable. Such installation in the past has proven to be cumbersome and labor intensive.

SUMMARY OF THE INVENTION

The present invention provides a magnetic switch unit for use in the above-described type of intrusion detection device, which is substantially easier and quicker to install than previously known constructions and which, in installed configuration, is disguised as an ordinary screw head. Briefly, a switch unit according to the invention includes a generally cylindrical housing member formed with a hollow interior cavity, which contains the switch or magnet. The exterior surface of the housing member is threaded and is formed at one end with a slot, Philips head, or the like to receive a screw driver. The unit is installed simply by screwing it into the supporting structure.

A switch unit according to the invention provides a substantial improvement in the time and labor required for installation. No special sealing measures are required. When installed, the device has the appearance of an ordinary screw head, which may be left exposed, without being recognizable as an intrusion detection device.

Other features and advantages of the invention will be apparent from the following specifications and appended drawings.

FIG, 3 is a perspective view of an alternative embodiment of a pair of switch units according to the invention.

Figure 1:
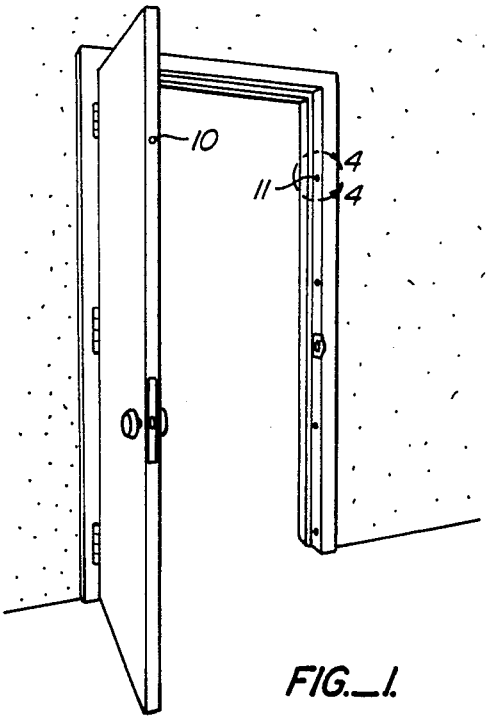
FIG. 1 shows a door assembly with a pair of magnetic switch units installed.
Figure 4:
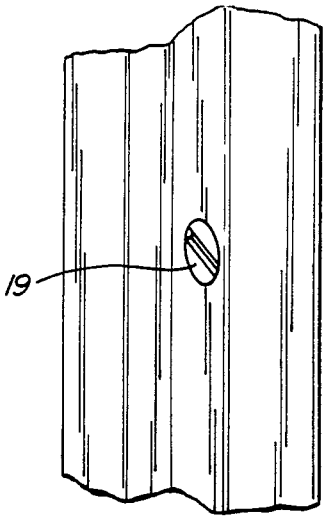

FIG. 4 shows an enlarged detail of an installed switch unit from FIG. 1.

DETAILED DESCRIPTION OF THE PREFERRED EMBODIMENTS

FIG. 1 shows a door assembly, in which an intrusion detection device as in the present invention has been installed. Although illustrated here in a door assembly, it is of course understood that the invention is not limited to use with doors, but may be applied in other types of entry ways or other configurations where it is desirable to disguise the detection device as a screw head. A first switch unit 10 is installed in the edge of the door, and a second switch unit 11 is installed in the door frame at a position opposite the first unit 10. The door unit 10 is a self-contained unit including a magnet. The frame unit 11 includes a magnetically sensitive switch generally connected by wires running through the door frame or wall to a control mechanism. When the door is closed, the frame unit 11 lies within the magnetic influence of the door unit 10. When the door is opened, that magnetic influence is removed and the frame unit 11 is activated.

Figure 2:
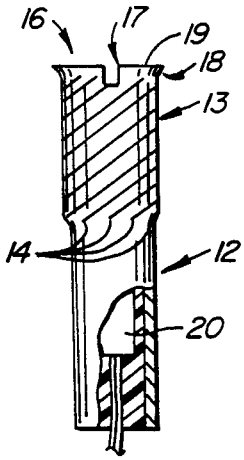
FIG. 2 is an elevational view, partially cut away, showing an embodiment of a switch unit according to the invention.

As shown in FIG. 2, a switch unit according to the invention includes a generally cylindrical housing member 12 which is formed with a threaded exterior surface 13. Although illustrated here in a truly cylindrical geometry, the housing member may be tapered without departing from the broad scope of the invention. Unlike a typical screw, which is formed with a single spiral thread, the embodiment of FIG. 2 includes a plurality of spiral threads 14, which are evenly disposed about the circumference of the housing member 12. The plurality of threads provides for firm and even gripping of the door or door frame as the unit is screwed in, The end portion 16 of the cylindrical member 12 is formed to receive a screw driver. As illustrated in FIG. 2, the end portion 16 defines a slot 17 to receive the flat blade of a conventional screw driver, The end portion, however, may also be formed to receive a Phillips head or other type of screw driver. The switch unit shown in FIG. 2 is formed with a flange 18,. such as found in a conventional screw head, and providing a stop so that the unit may be installed at a controlled depth, at which the face 19 of the end portion is in flush, or slightly counter-sunk, disposition.

The same housing may be used with both the magnet and with the magnetically sensitive switch. When it is not necessary to distinguish between magnet or switch, these are referred to generically herein as operative detection elements. The cylindrical housing member 12 is hollow so as to define an interior cavity. The operative detection element is contained within the cavity and fixed in position by appropriate means, such as epoxy resin, well known to those skilled in the art. FIG. 2 includes a partially cutaway portion revealing an operative detection element 20 so mounted within the housing.

Figure 3:
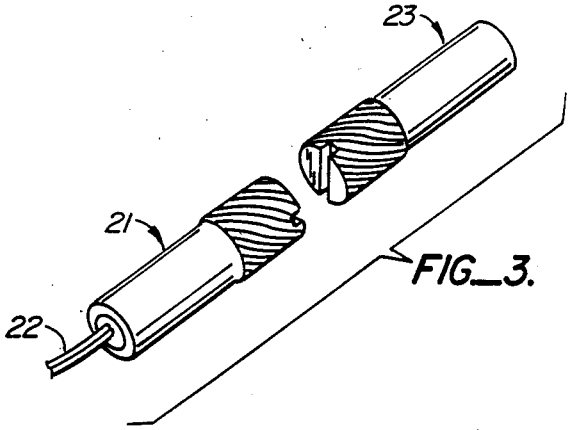

FIG. 3 shows a pair of switch units in their approximate relative disposition in their installed configuration. The switch side 21 includes wires 22 leading to the controller. The magnet side 23 is self-contained. To permit adjustment of the depth at which the unit is installed, the cylindrical members shown in FIG. 3 are formed with no flange or other member interrupting the threads or providing a stop or locating function. That is, the threaded exterior portion of the cylindrical member extends right up to the end portion so as to form a geometrical right cylinder with the face of the end portion. Formed in this manner, the unit may freely be screwed in or out so as to set the depth at which the unit is installed and thereby to adjust the gap between the paired units and hence the sensitivity of the intrusion detector.

FIG. 4 shows an enlarged view of an installed switch unit disguised as a screw head.

While the above provides a full disclosure of illustrative embodiments of the invention, various modifications, alternate constructions, and equivalents may be employed without departing from the spirit and scope of the invention, Therefore, the invention is not to be limited to the above illustrative embodiments, but is defined by the appended claims.

What is claimed is:

1. A magnetic switch unit for use in an intrusion detection device for mounting in a door or window assembly, comprising:

a generally cylindrical hollow housing member formed with a threaded exterior surface and having an end portion formed to receive a screw driver for screwing said housing member directly into said door or window assembly; and an operative detection element fixed within said hollow housing member for detecting the movement of said door or window assembly;

whereby said magnetic switch unit is adapted to be threadably installed directly into said door or window assembly.

2. The apparatus of claim 1 wherein said housing member is formed with a plurality of spiral threads on said exterior surface.

3. The apparatus of claim 2 wherein said spiral threads are evenly disposed about said housing member.

4. The apparatus of claim 1, further comprising a flange about said end portion.

5. The apparatus of claim 1 wherein said threaded exterior surface meets said end portion, without interruption, in a right cylinder.

6. A magnetic switch housing for use in an intrusion detection device for mounting in a door or window assembly, comprising:

a generally cylindrical member defining a hollow interior cavity sized and dimensioned to receive an operative detection element;

said member being formed with a threaded exterior surface and having an end portion formed to receive a screw driver, whereby said housing may be threadably installed in said door or window assembly.

7. A method of installing an intrusion detection unit in a supporting member comprising the steps of:

providing an intrusion detectin unit having a generally cylindrical housing of characteristic diameter and having a threaded exterior surface;

pre-drilling a hole in said supporting member sized to snugly receive said characteristic diameter; and screwing said housing into said hole.

* * * * *